US007802995B2

(12) United States Patent
Lai

(10) Patent No.: US 7,802,995 B2
(45) Date of Patent: Sep. 28, 2010

(54) ROTATABLE CONNECTOR CONNECTING TWO FLEXIBLE PRINTED CIRCUIT BOARDS

(75) Inventor: Jin-Shi Lai, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/538,863

(22) Filed: Aug. 11, 2009

(65) Prior Publication Data

US 2010/0075512 A1 Mar. 25, 2010

(30) Foreign Application Priority Data

Sep. 25, 2008 (CN) ..... 2008 1 0304652

(51) Int. Cl.
*H01R 39/00* (2006.01)
*H01R 12/00* (2006.01)

(52) U.S. Cl. ..... 439/66; 439/67; 439/21

(58) Field of Classification Search ..... 439/66, 439/67, 65, 69, 21, 22, 27, 29, 30, 77
See application file for complete search history.

(56) References Cited

U.S. PATENT DOCUMENTS

| | | | | |
|---|---|---|---|---|
| 5,704,792 | A * | 1/1998 | Sobhani | 439/21 |
| 6,083,022 | A * | 7/2000 | Walkup | 439/260 |
| 7,252,513 | B1 * | 8/2007 | Hildebrand et al. | 439/63 |
| 2007/0218713 | A1 * | 9/2007 | Kato | 439/67 |
| 2009/0236480 | A1 * | 9/2009 | Lai | 248/206.5 |

* cited by examiner

*Primary Examiner*—Chandrika Prasad
(74) *Attorney, Agent, or Firm*—Frank R. Niranjan

(57) ABSTRACT

A rotatable connector includes a first rotating member, a second rotating member rotatable relative to the first rotating member, at least one conductive connecting member sandwiched between the first rotating member and the second rotating member, and a shaft. The first rotating member includes a first rotating body and a first flexible printed circuit board fixed to the first rotating body. The first rotating body includes at least one conductive portion electrically connected to the first flexible printed circuit board. The second rotating member includes a second rotating body and a second flexible printed circuit board fixed to the second rotating body. The second rotating body includes at least one conductive protrusion. The at least one conductive connecting member electrically connects the least one conductive protrusion to the at least one conductive portion. The shaft extends through the first rotating body, the second rotating body and the second flexible printed circuit board.

8 Claims, 3 Drawing Sheets

ROTATABLE CONNECTOR CONNECTING TWO FLEXIBLE PRINTED CIRCUIT BOARDS

BACKGROUND

1. Technical Field

The present disclosure relates to a rotatable connector.

2. Description of Related Art

Generally, a rotating mechanism includes a first rotating part, a second rotating part, and a control unit for controlling the second rotating part to rotate relative to the first rotating part. The control unit is electrically connected to the two rotating parts by wires. However, when the second rotating part rotates relative to the first rotating part, the wires are easy to get intertwined and may be damaged or broken. This is inconvenient.

Therefore, what is needed is to provide a rotatable connector for a rotating mechanism, in which the limitations described, are eliminated or at least alleviated.

DETAILED DESCRIPTION

Figure 1:
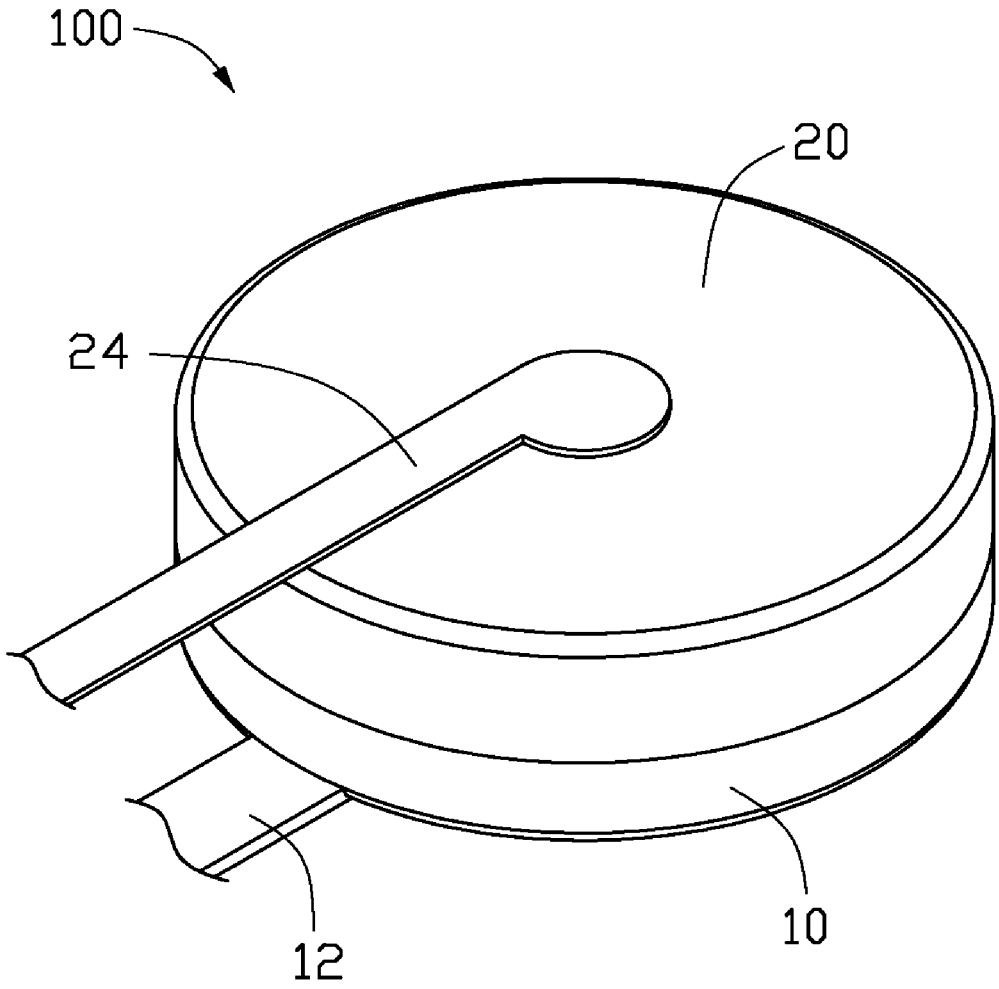
FIG. 1 is a schematic isometric view of a rotatable connector, according to an exemplary embodiment.
Figure 2:
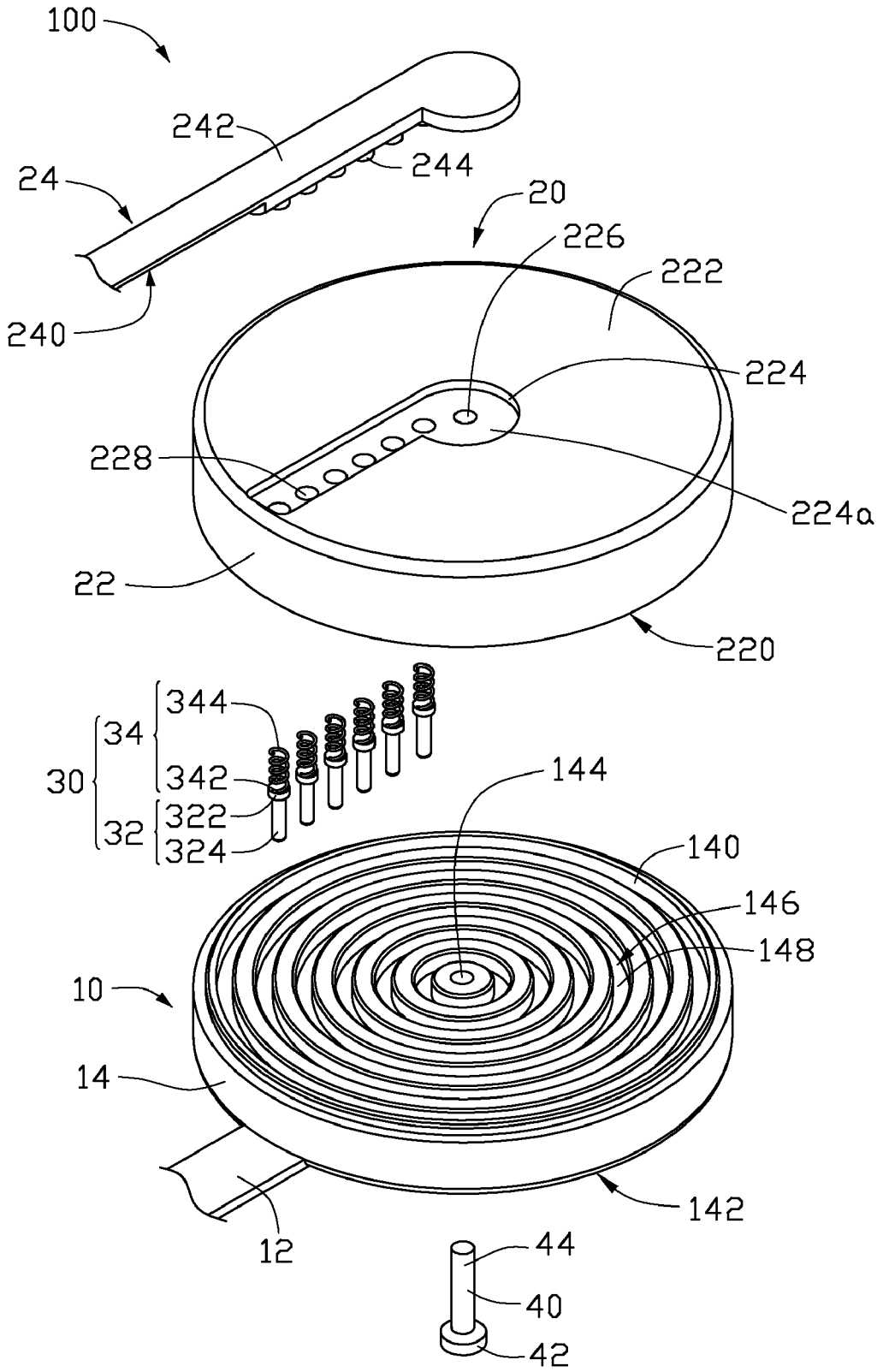
FIG. 2 is an exploded view of the rotatable connector of FIG. 1.

Referring to FIGS. 1 and 2, a rotatable connector 100, according to an exemplary embodiment, includes a first rotating member 10, a second rotating member 20 rotatable relative to the first rotating member 10, six conductive connecting members 30, and a shaft 40.

The first rotating member 10 includes a first flexible printed circuit board (FPCB) 12 and a first rotating body 14.

Six wires (not shown) are laid on the first FPCB 12. One end of the first FPCB 12 is fixed to the first rotating body 14, the other end of the first FPCB 12 is attached to a first rotating part (not shown) of a rotating mechanism (not shown).

The first rotating body 14 is disc-shaped and includes a first surface 140 and a second surface 142. The first surface 140 and the second surface 142 are on opposite sides of the first rotating body 14. A first through hole 144 is defined at the center of the first rotating body 14. Six circular sliding grooves 146 with different diameters are defined in the first surface 140 corresponding to the six connecting members 30, coaxial with the first through hole 144. The sliding grooves 146 encircles the first through hole 144 and are equidistant from each other. The first rotating body 14 further includes six conductive portions 148 positioned in the bottoms of the sliding grooves 146 respectively. The six conductive portions 148 are electrically connected to the six wires of the FPCB 12 respectively.

The second rotating member 20 includes a second rotating body 22 and a second flexible printed circuit board (FPCB) 24.

The second rotating body 22 includes a third surface 220 and a fourth surface 222. The third surface 220 faces the first surface 140. The third surface 220 and the fourth surface 222 are on opposite sides of the second rotating body 22. A receiving groove 224 is defined in the fourth surface 222 and shaped corresponding to the second FPCB 24. A second through hole 226 is defined in a bottom 224*a* of the receiving groove 224 corresponding to the first through hole 144. Six stepped through holes 228 are defined in the bottom 224*a* of the receiving groove 224 corresponding to the six guiding grooves 146. The six stepped through holes 228 are arranged in line and are equidistant from each other.

Figure 3:
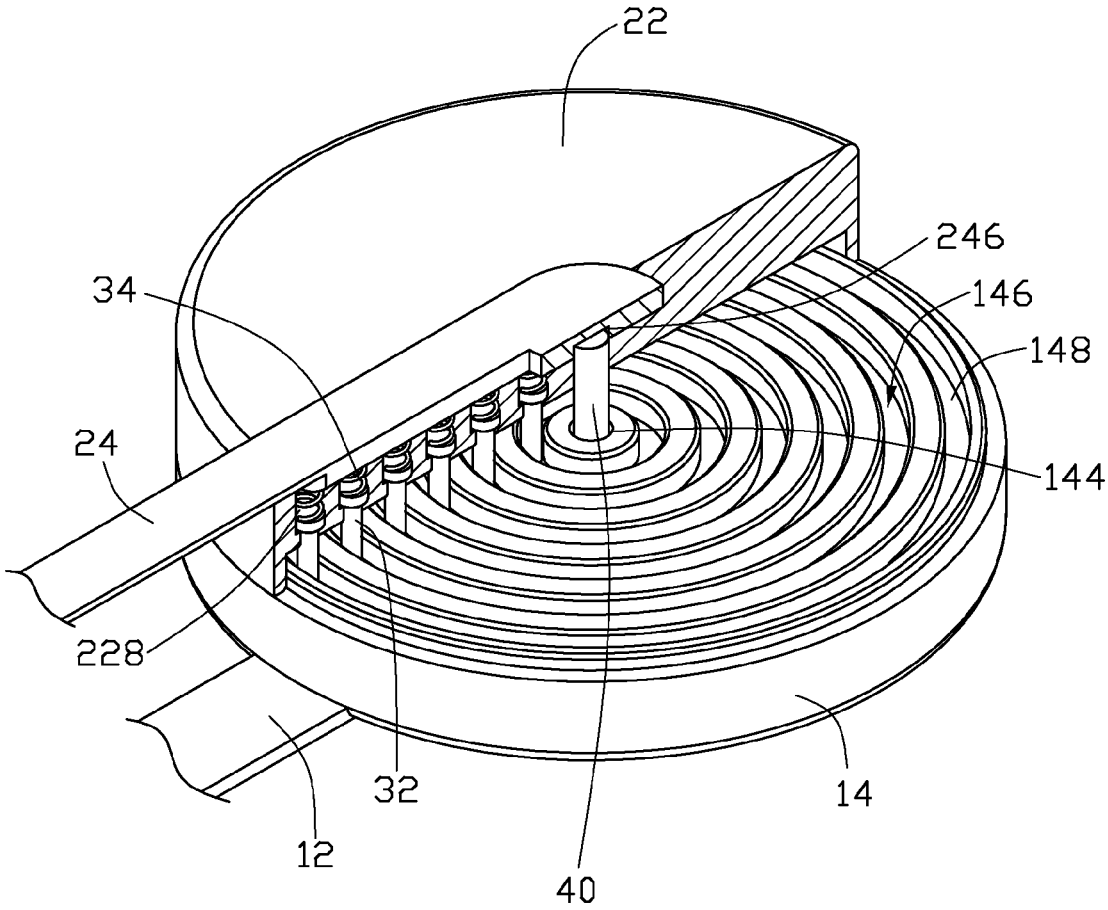
FIG. 3 is a partial, cut-way view of the rotatable connector of FIG. 1.

Referring to FIG. 2 together with FIG. 3, other six wires (not shown) are laid on the second FPCB 24. The second FPCB 24 includes a fifth surface 240 and a sixth surface 242. The fifth surface 240 faces the fourth surface 222. The fifth surface 240 and the sixth surface 242 are on opposite sides of the second FPCB 24. Six conductive protrusions 244 are formed in the fifth surface 240 corresponding to the six stepped through holes 228. A fixing hole 246 is defined in the fifth surface 240 corresponding to the second through hole 226 and the first through hole 144. One end of the second FPCB 24 is firmly received in the receiving groove 224, and the six conductive protrusions 244 are engaged with the six stepped through hole 228 respectively so that the second FPCB 24 is fixed to the second rotating body 22. The other end of the second FPCB 22 is attached to a second rotating part (not shown) of the rotating mechanism.

Each connecting member 30 includes a conductive pole 32 and a conductive spring 34. Each conductive pole 32 includes a supporting portion 322 and a connecting portion 324 extending from the supporting portion 322. Each supporting portion 322 is supported in the corresponding stepped through hole 228. Each connecting portion 324 extends through the corresponding stepped through holes 228 and is received in the corresponding sliding groove 146 to maintain contact with the conductive portion 148. Each conductive spring 34 is received in the corresponding stepped through hole 228. One end 342 of the conductive spring 34 is fixed to the supporting portion 322, and the other end 344 is fixed to the conductive protrusion 244.

The shaft 40 includes a fixing portion 42 and a shaft body 44 extending from the fixing portion 42. The shaft body 44 extends through the first through hole 144, the second through hole 226 and the fixing hole 246 by clearance fit. The fixing portion 42 contacts the second surface 142. As a result, the first rotating body 14 can rotate about the shaft body 44 with the rotation of the first rotating part of the rotating mechanism. The second rotating body 22 can rotate about the shaft body 44 with the rotation of the second rotating part of the rotating mechanism.

When the second rotating body 22 rotates relative to the first rotating body 14, the connecting members 30 rotate with the rotation of the second rotating body 22. The connecting portions 324 are received in the sliding grooves 146 to maintain contact with the conductive portion 148. As a result, electrical signals from the second FPCB 24 are transmitted to the first FPCB 12 through the conductive protrusions 244, the connecting members 30 and the conductive portions 148, avoiding wires getting intertwined. This is convenient.

In an other exemplary embodiment, the amount of the connecting member 30 is not limited to six, the rotatable connector 100 may include at least one connecting member 30 corresponding to the sliding grooves 146 and the conductive protrusions 244. The sliding grooves 146 may be an arc. In this case, the length of the sliding grooves 146 is decided by the rotational angle of the second rotating body 22.

It is to be understood, however, that even though numerous characteristics and advantages of the present embodiments have been set fourth in the foregoing description, together with details of the structures and functions of the embodiments, the disclosure is illustrative only, and changes may be made in details, especially in matters of shape, size, and arrangement of parts within the principles of the invention to the full extent indicated by the broad general meaning of the terms in which the appended claims are expressed.

What is claimed is:

1. A rotatable connector comprising:

a first rotating member comprising a first rotating body and a first flexible printed circuit board fixed to the first rotating body, the first rotating body comprising at least one conductive portion electrically connected to the first flexible printed circuit board;

a second rotating member rotatable relative to the first rotating member comprising a second rotating body and a second flexible printed circuit board fixed to the second rotating body, the second rotating body comprising at least one conductive protrusion;

at least one conductive connecting member sandwiched between the first rotating member and the second rotating member, the at least one conductive connecting member electrically connecting the at least one conductive protrusion to the at least one conductive portion; and a shaft extending through the first rotating body, the second rotating body and the second flexible printed circuit board so that the second rotating body can rotate relative to the first rotating body.

2. The rotatable connector as claimed in claim 1, wherein the first rotating body further comprises a first surface and a second surface opposite to the first surface, at least one sliding groove is defined in the center of the first surface corresponding to the at least one connecting member, and the at least one conductive portion is received in the bottom of the at least one sliding groove.

3. The rotatable connector as claimed in claim 2, wherein a first through hole is defined in the center of the first surface, and the at least one sliding groove encircles the first through hole.

4. The rotatable connector as claimed in claim 2, wherein a first through hole is defined in the center of the first surface, and the at least one sliding groove is an arc around the first through hole.

5. The rotatable connector as claimed in claim 3, wherein the second rotating body comprises a third surface facing the first surface and a fourth surface opposite to the third surface; a receiving groove is defined in the fourth surface shaped to the second flexible printed circuit board, and at least one stepped through hole is defined in the bottom of the receiving groove corresponding to the at least one connecting member; the second flexible printed circuit board comprises a fifth surface facing the fourth surface and a sixth surface opposite to the fifth surface; the at least one conductive protrusion is formed in the fifth surface corresponding to the at least one stepped through hole; the second flexible printed circuit board is firmly received in the receiving groove, and the at least one conductive protrusion is engaged with the at least one stepped through hole so that the second flexible printed circuit board is fixed to the second rotating body.

6. The rotatable connector as claimed in claim 5, wherein a second through hole is defined in the bottom of the receiving groove corresponding to the first through hole, and a fixing hole is defined in the fifth surface corresponding to the second through hole and the first through hole; the shaft comprises a fixing portion and a shaft body extending from the fixing portion, and the shaft body extends through the first through hole, the second through hole and the fixing hole by clearance fit.

7. The rotatable connector as claimed in claim 6, wherein the at least one connecting member is received in the at least one stepped through hole, and comprises a conductive pole and a conductive spring; the conductive pole extends through the corresponding stepped through hole and is received in the corresponding sliding groove to maintain contact with the corresponding conductive portion; and the conductive spring connects the corresponding conductive protrusion to the corresponding conductive pole.

8. The rotatable connector as claimed in claim 7, wherein each conductive pole comprises a supporting portion and a connecting portion extending from the supporting portion; each supporting portion is supported in the corresponding stepped through hole; each connecting portion extends through the corresponding stepped through hole and is received in the corresponding sliding groove to maintain contact with the corresponding conductive portion; each conductive spring is received in the corresponding stepped through hole, one end of the conductive spring is fixed to the supporting portion, and the other end is fixed to the conductive protrusion.

* * * * *